US005201333A

United States Patent [19]

Shalmon et al.

[11] Patent Number: 5,201,333

[45] Date of Patent: Apr. 13, 1993

[54] FOLDING WALKER

[75] Inventors: Shay Shalmon, Port Washington; Ronald Simon, Center Moriches, both of N.Y.

[73] Assignee: Lumex, Inc., Bay Shore, N.Y.

[21] Appl. No.: 757,200

[22] Filed: Sep. 10, 1991

[51] Int. Cl.[5] ..... A61H 3/00

[52] U.S. Cl. ..... 135/67; 403/327; 403/325

[58] Field of Search ..... 403/327, 325, 328, 113; 135/67

[56] References Cited

U.S. PATENT DOCUMENTS

| | | | |
|---|---|---|---|
| 2,667,914 | 4/1954 | Forbes . | |
| 2,796,916 | 6/1957 | Womble . | |
| 2,817,387 | 2/1957 | Blake . | |
| 2,960,148 | 10/1960 | Murcott . | |
| 2,996,070 | 8/1961 | Ries . | |
| 3,442,276 | 11/1969 | Edwards et al. . | |
| 3,516,425 | 11/1970 | Rigal . | |
| 3,517,677 | 11/1970 | Smith . | |
| 3,658,079 | 4/1972 | Block . | |
| 3,688,789 | 9/1972 | Bunch . | |
| 3,783,886 | 1/1974 | Thomas . | |
| 3,945,389 | 3/1976 | Smith . | |
| 3,993,088 | 3/1976 | Thomas . | |
| 4,180,086 | 12/1979 | Thomas . | |
| 4,298,016 | 11/1981 | Garelick . | |
| 4,748,994 | 6/1988 | Schultz et al. . | |
| 4,830,035 | 5/1989 | Lia | 403/327 |
| 4,907,794 | 3/1990 | Rose . | |
| 4,907,839 | 3/1990 | Rose et al. . | |
| 4,954,008 | 9/1990 | Dicke | 403/327 |

*Primary Examiner*—Henry E. Raduazo
*Attorney, Agent, or Firm*—Davis, Hoxie, Faithfull & Hapgood

[57] ABSTRACT

A folding walker with side frames rotationally mounted on both ends of a front frame such that the side frames can rotate independently from a closed position where they are parallel to the front frame to an open position where the side frames are perpendicular to the front frame and parallel to each other. The side frames are locked in the open position by fixed plates that are mounted on the front frame. Detents with lever releases are mounted on the side frames. The detents releasably engage the fixed plates when the side frames are in the open position.

28 Claims, 3 Drawing Sheets

FOLDING WALKER

FIELD OF THE INVENTION

The present invention relates to a folding walker for use by the aged or infirmed.

BACKGROUND OF THE INVENTION

Many of the aged or infirmed have difficulty walking because they have weak legs or poor balance. In order to help these people remain independently mobile, various walking devices have been developed that allow the user to support his weight at least partially with his arms.

The open walking frame or walker is such a device. Walkers generally consist of four legs attached by some form of square frame with at least one side open so that the user can stand within the four legs. The frame has handles so the user can pick up the walker, set it in front of him, and lean on it as he walks forward. In this way, the user can support some of his weight with his arms and shoulders. Further, the user can balance his weight more easily by shifting his weight to the different sides of the walker.

Walkers have been developed that fold into a small space so that they can be more easily stored when not in use. See, for example, U.S. Pat. Nos. 3,945,389, 3,658,079, 3,993,088, 4,180,086 and 4,298,016. In these patents, the walkers are comprised of 3 frames, one in the front and one on each side. The user steps into the frame from the rear. When the walker is not being used, the side frames can each be rotated onto the front frame of the walker to reduce storage space. The side frames are locked in the open position by various mechanisms.

The folding walker shown in U.S. Pat. No. 3,945,389 employs a brace extending from a rear leg to a front leg of the side frame. The locking mechanism consists of a sliding pad that is pinned onto the side frame at a single point on the bottom of the brace. The sliding pad is slidingly mounted onto the front frame by a front pin, which moves along in a notch in the sliding pad as the side frame is opened and closed. A detent is mounted on the front frame. As the side frame is opened, the detent pin slips into a hole on the sliding pad and thereby prevents the pad from sliding about the front pin. Thus, the side frame is prevented from opening or closing by the sliding pad. To unlock the sliding pad, the user must reach from the handle on the side frame to a small tab on the sliding pad at the front frame to depress the detent pin. This tab is located in front of the front foot of the walker.

The folding walker shown in U.S. Patent No. 4,298,016 employs a notched rod that is pinned at a single point onto the side frame at the bottom of a brace on the side frame. This rod fits within a spring-biased housing that is mounted on the front frame. When the side frame is opened to the proper position, the housing latches onto the notch in the rod, keeping the rod from moving and thereby preventing any further rotation by the side frame. To fold the walker, the user must reach from the handle on the side frame to the housing on the front frame, depress it (thus releasing the rod) and simultaneously close the side frame.

Other folding walkers have locking means consisting of telescoping rods attached to the front and side frames or detents mounted on the legs of the walker that prevent the legs from rotating.

SUMMARY OF THE INVENTION

The walker of the present invention provides a stable folding walker of adjustable height that can be easily folded but will not accidentally fold during use. The walker not only provides a truss that firmly holds the side frame open but also provides a cantilever support that increases the stability of the walker by reducing flexing of the side frame about its hinge.

It is an object of this invention to provide a folding walker that firmly locks the side frames into place during use. Further, it is an object of this invention to provide a walker where each side of the frame folds independently of one another and where the user can easily and quickly fold each side frame.

The folding walker of the present invention comprises a front frame and two side frames. At least one side frame is rotationally mounted on the front frame. A rigid member is fixedly mounted on the front frame. As the side frame is rotated into an open position, the side frame becomes lockingly engaged to the member such that the side frame cannot rotate close. There is a means for disengaging the side frame.

In the preferred embodiment, both side frames are rotationally mounted on the ends of the front frame. The member is a plate which is fixedly mounted onto the front frame. A detent is mounted on the side frame. When the side frame is rotated to the open position, the pin of the detent is located directly over a hole in the plate and protrudes therethrough into locked engagement with the plate. The pin can be released from locked engagement by depressing a lever which thereby lifts the pin out of the hole.

BRIEF DESCRIPTION OF THE DRAWINGS

In the drawings, which are illustrative of an embodiment of the invention.

DETAILED DESCRIPTION

Figure 1:
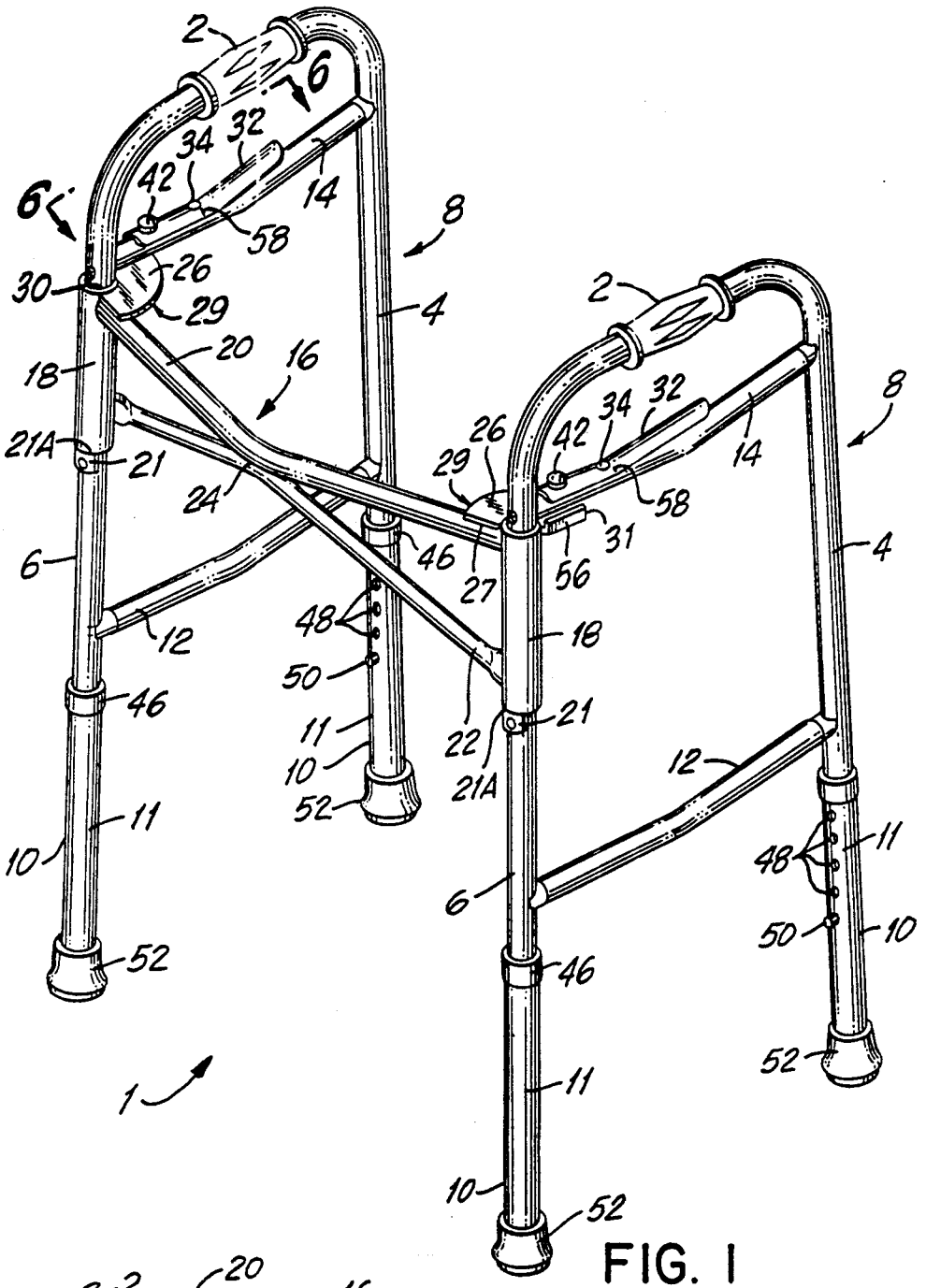
FIG. 1 is a perspective view of a folding walker of the present invention with the side frames in an open position.

FIG. 1 shows a preferred embodiment of an adjustable folding walker of the present invention in the open position. The walker comprises three frames, namely, two side frames 8 connected to one another by a front frame 16. Each side frame 8 is constructed of a lightweight metal, such as aluminum, and is configured as a hollow cylindrical tube. Each side frame 8 is generally in the shape of an arch, extending down to the floor through two legs, a front leg 6 and a rear leg 4.

The front frame 16 comprises two hinge tubes 18 that are connected to one another by two support members. An upper support member 20 of the front frame 16 is a cylindrical tube that is welded to the hinge tubes 18 just below the top of each hinge tube. A lower support member 22 is a cylindrical tube that is welded to the hinge tubes near the bottom of each hinge tube. The lower support member 22 is bent up such that it is in the shape of an inverted "v", with the base of the inverted "v" being welded to a center point 24 on the upper support member 20. Each hinge tube 18 has an inner radius greater than the outer radius of each front leg 6, and thus each hinge tube 18 envelopes its respective front leg 6 of the side frame 8 to permit the side frame 8 to rotate about its front leg 6, as described in more detail below.

The walker has grips 2 mounted on the top of the side frames 8. The user holds onto the grips 2 with his hands when leaning on the walker, and thus uses his arms to help support his body weight with the walker. The grip 2 is made of a soft plastic or other material suitable for holding without slipping. The grip 2 is in the shape of a tube, with an inner diameter larger than the side frame tubing so that it fits tightly. The grip is slightly wider in its center with ridges along its length, for easier gripping.

From each end of the grip 2, the tube of the side frame 8 extends out and then curves down toward the floor, forming the rear leg 4 and the front leg 6. The legs 4, 6 are further apart at the bottom than at the top in order to improve stability of the walker as better seen in FIG. 2.

Mounted on the bottom of the front legs 6 and the rear legs 4 are adjustable feet 10. Each adjustable foot 10 comprises a tube 11 with a rubber tip 52 on its end to prevent slipping. The inner diameter of each tube 11 is slightly larger than the outer diameter of the tube of the side frame 8, so that the foot 10 fits snugly over the bottom of the legs 4, 6. A plug cap made of a soft material such as plastic, is inserted into the side frame tube at the bottom of each leg. This plug cap has a diameter nearly the same as the inner diameter of the tube 11 so that the plug cap is in positive contact with the inner diameter of the foot 10 at all times.

Mounted on the top of each foot 10 is a ring cap 46 made of a soft material such as rubber. This ring cap has an inner diameter nearly the same as the outer diameter of the side frame tube so that the ring cap 46 is in positive contact with the side frame tube at all times. Due to the positive contact by the ring cap 46 and the plug cap, the foot 10 is prevented from wobbling about the side frame tube. This increases the stability of the walker.

There is a detent pin 50 in the bottom of each leg. There are a series of holes 48 in the tube 11 of foot 10, running down the side of the foot, in line, equidistant from each other. Each hole 48 has a diameter just slightly larger than the detent pin 50 in the bottom of the side frame tube. When a hole 48 is positioned over the detent pin 50, the pin protrudes therethrough. The foot is thereby held in position on the leg, as is well known in the art. Consequently, the load from the side frame 8 travels through the detent pin to the foot 10. The height of the walker can be changed by moving the detent pins 50 over a different set of holes 48 in the foot 10. As the holes are changed, the legs 4, 6 of the side frame 8 are raised or lowered, thereby raising or lowering the height of the walker.

While in the preferred embodiment each leg 4, 6 terminates in a foot 10, it should be understood that accessories which are common in the industry, such as wheels on the front legs 6, can be substituted for the foot 10 while still practicing the invention. Further, the walker of this invention can be scaled for use by a particular user, or scaled in several sizes, such as "child" and "adult," while the adjustable feet 10 can be manipulated to suit the particular user.

Figure 2:
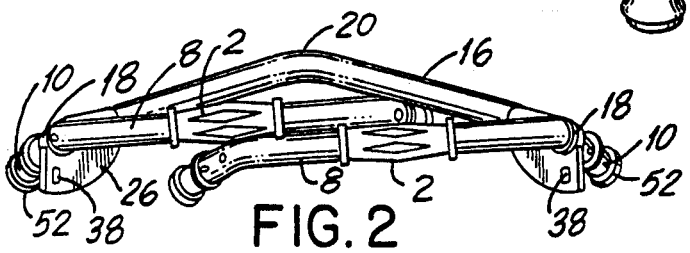
FIG. 2 is a top view of the folding walker of FIG. 1 with the side frames in a closed position.

FIG. 2 shows a top view of the walker of FIG. 1 in the closed position. The side frames 8 are folded over and rest adjacent to the front frame 16.

Figure 3:
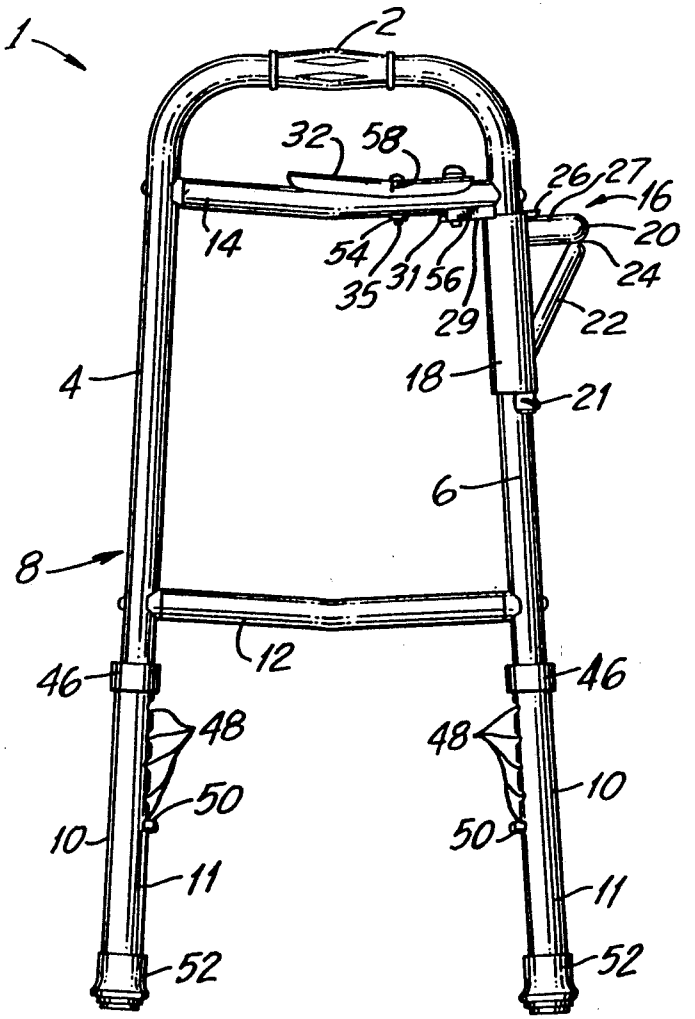
FIG. 3 is a side view of the folding walker of FIG. 1 with the side frames in an open position.

FIG. 3 shows a side view of the walker in the open position. Upper cross braces 14 and lower cross braces 12 connect the legs 4, 6 to increase the stability of the side frame 8. Lower cross brace 12 is fixedly mounted to the front leg 6 of the side frame 8 and to the rear leg 4 of the side frame 8 by means of a screw and plastic washer in the walker. Upper cross brace 14 is similarly fixedly mounted to the front leg 6 and the rear leg 4. The upper cross brace 14 is positioned approximately 4 inches below the grip 2 such that the cross brace 14 may be easily reached by the user without bending.

Figure 4:
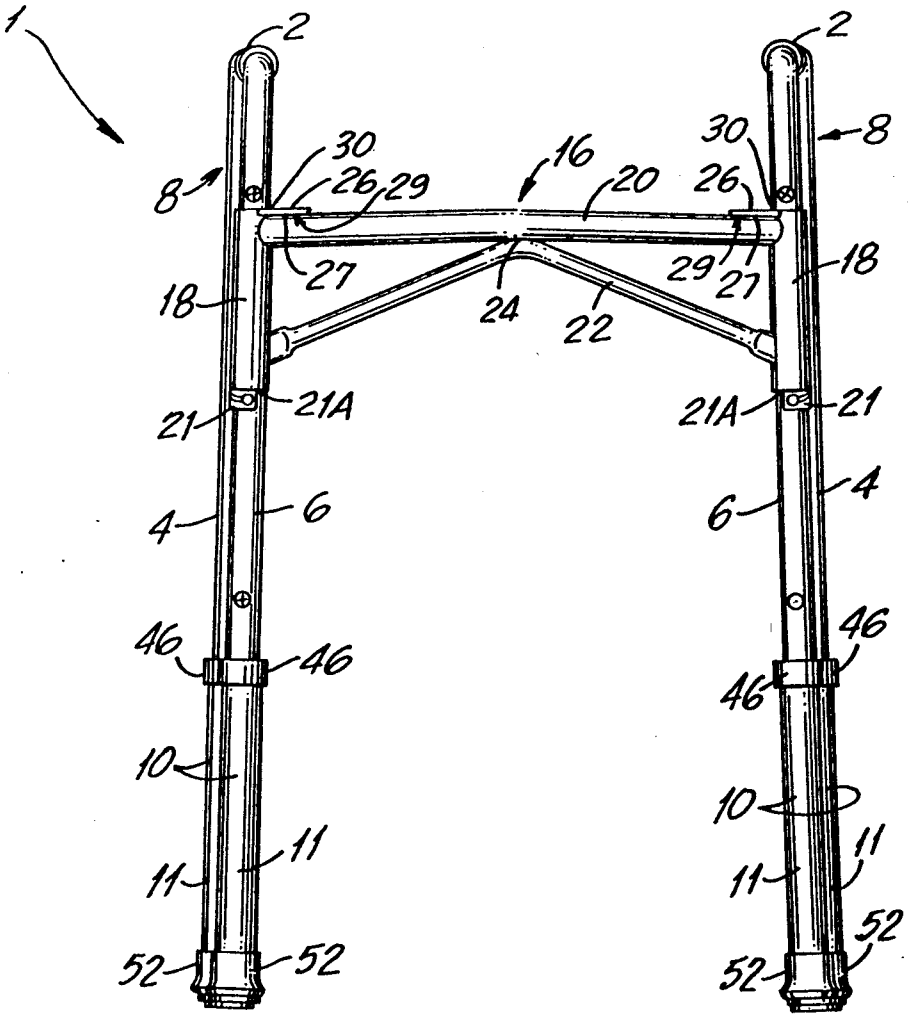
FIG. 4 is a front view of the folding walker of FIG. 1 with the side frames in an open position.

FIG. 4 is a front view of the walker in the open position. The hinge tubes 18 are positioned on the front legs 6, just below the upper cross braces 14 (shown in FIG. 3). Each hinge tube 18 is prevented from sliding down its respective front leg 6 by a side frame pin 21. The side frame pin 21 is mounted on the front leg 6 and has a flat top 21*a* on which the hinge tube 18 can slide when rotating without snagging. The side frames 8 lean in toward each other at the top to increase the stability of the walker.

Figure 5:
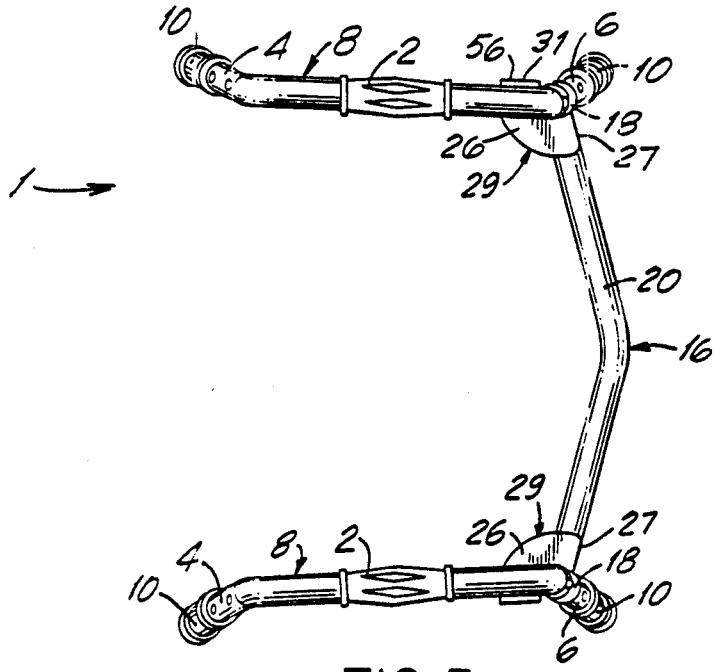
FIG. 5 is a top view of the folding walker of FIG. 1 with the side frames in an open position.

FIG. 5 is a top view of the walker of FIG. 1 in the open position. The upper support member 20 protrudes out in a forward direction at the middle so that there is more room for the user to walk without hitting the front frame. The lower support member 22 is similarly bent forward in order to give the user more room to walk.

A plate 26 is fixedly mounted on the hinge tube 18 and the upper support member 20. The plate 26, preferably made of steel, is a section of a circular disc encompassing more than 90 degrees of arc. A portion 27 of a bottom surface 29 of the plate 26 is welded to the upper support member 20. The inner circumferential edge 30 (shown in FIG. 1) of each plate 26 is welded to the top of the corresponding hinge tube 18. Thus, the upper support member 20, the hinge tubes 18 and the plates 26 constitute a rigid structure.

One edge 31 of plate 26 terminates in a raised lip 56. This lip 56 is of such a height that the upper cross brace 14 of the side frame 8 will contact the lip 56 if the side frame 8 is opened too widely. In this way, the side frame 8 is prevented from opening too far.

Figure 6:
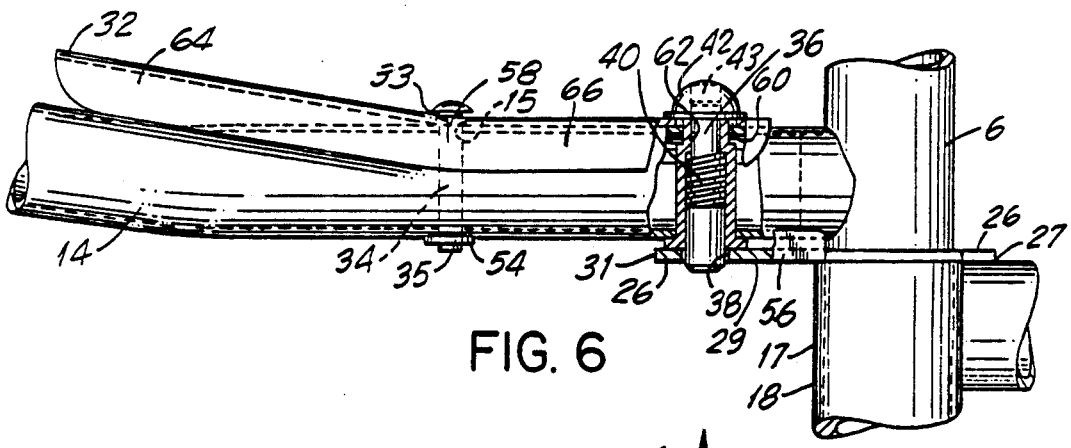
FIG. 6 is a partial cut-away side view along lines 6—6 of FIG. 1 showing the locking mechanism of the folding walker of the present invention with the side frame locked in the open position.

FIG. 6 is a partial cut-away view along lines 6—6 of FIG. 1 showing the locking mechanism for the walker. It is understood that the locking mechanism shown in FIG. 6 is identical to the locking mechanism on the other side of the walker. As noted above, each hinge tube 18 has an inside diameter slightly larger than the outside diameter of the side frame tubes 8. Positioned between the hinge tube 18 and the side frame 8 is a sleeve 17, preferably made of nylon, that allows the side frame 8 to rotate within the hinge tube 18. A lever 32 is pivotally mounted by a pivot pin 34 on the upper cross brace 14. This pivot pin 34 extends from above the lever 32, through its fulcrum 33, through a radial opening 15 in the upper cross brace 14, and extends out the bottom of the upper cross brace 14. The pivot pin 34 is capped by a washer 54. The tip 35 of the pin 34 is enlarge after it is inserted in place so that the pin 34 cannot fit back through the radial opening 15 in the upper cross brace 14. The pin 34 is mounted such that there is room for the lever 32 to rotate about the fulcrum 33.

The lever 32 is curved to fit closely over the tube of the upper cross brace 14. The lever 32 is bent upwardly at an intermediate point 58 to form a chevron so that the entire lever 32 cannot rest on the upper cross brace at one time.

A locking pin 36 is also mounted on the upper cross brace 14. This locking pin 36 is mounted towards the front of the upper cross brace 14 such that the locking pin 36 is aligned over a hole 38 in the plate 26 when side frame 8 is open. The locking pin 36 is biased downwardly by a spring 40. The locking pin 36 passes through a radial aperture 60 near the front end of the lever 32, and then through a radial aperture 62 in the upper cross brace 14. A mounting cap 42 is placed over the top 43 of the locking pin 36.

When the side frame 8 is in the closed position, the locking pin 36 is prevented from succumbing to the bias supplied by spring 40 because the plate 26 is beneath radial aperture 62 in the upper cross brace 14. As the side frame 8 is rotated within the hinge tube 18, the locking pin 36 remains depressed due to the plate 26. When the side frame 8 is in the open position, i.e., rotated about 90 degrees from the front frame 16, the locking pin 36 aligns directly above the hole 38 in the plate 26 as shown in FIG. 6. Consequently, the locking pin 36 is no longer restrained by the plate 26 and extends into the hole 38. The extension of the locking pin 36 into hole 38 creates an audible "click" that signals the user that the side frame 8 is locked open. This locked engagement of the plate 26 (which is fixed to the front frame 16) and the locking pin 36 (which is fixed to the side frame 8) prevents the side frame 8 from moving with respect to the front frame 16 during operation. If force was exerted on the side frame 8 to close the rear legs 4, the side frame 8 would have to rotate. Rotation of the side frame 8 would result in rotation of the upper cross brace 14 that is mounted on the side frame 8. Rotation of the upper cross brace 14 would require the displacement of the locking pin 36 that is mounted on the upper cross brace 14. Since the locking pin 3 is fixedly engaged to the hole 38 in the plate 26, and the plate 26 is in turn fixedly mounted on the front frame 16, the locking pin 36 cannot translate with respect to the front frame 16. Consequently, the side frame 8 on which the locking pin 36 is mounted, cannot rotate toward the front frame 16. The locking pin 36 is kept in the locked condition due to the bias from spring 40.

Figure 7:
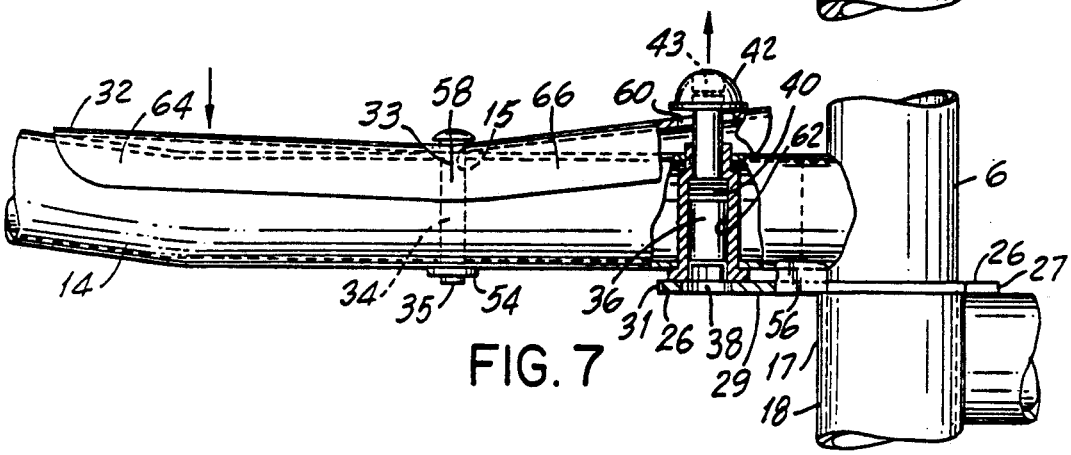
FIG. 7 is a partial cut-away side view, similar to FIG. 6, of the locking mechanism of the folding walker of the present invention with the side frame in the open position and the locking mechanism unlocked.

FIG. 7 is a detailed view of the locking mechanism in the unlocked position. The lever 32 is a chevron-shaped bar bent at an intermediate point 58 pivotally mounted at the intermediate point 58 to the top of the upper cross brace 14 of the side frame 8 by the pivot pin 34. The lever 32 has a front part 66 and a rear part 64. The front part 66 of the lever 32 is attached to the top 43 of the locking pin 36 by the mounting cap through the radial aperture 60 in the lever. To close the side frame 8, the locking pin 36 must be removed from locked engagement with hole 38. As the rear part 64 of the lever is depressed (i.e., pushed toward the upper cross brace 14), the lever 32 pivots above its fulcrum 33 and the front part 66 lifts off of the upper cross brace 14. Thus, the locking pin 36, which is attached to the front part 66, is lifted up, overcoming the bias of spring 40. Consequently, the locking pin is removed from interlocking engagement with the hole 38 in the plate 26. The side frame 8 is thereby free to rotate within the hinge tube 18 because the plate 26 of the front frame 8 is no longer in locked engagement with the locking pin 36 of the side frame 8. The rear part 64 of the lever 32 is large enough that it can be easily depressed by the user's hand, forearm or elbow. Consequently finger dexterity is not required to fold the walker.

The side frame 8 is prevented from rotating to a position further than about 90° from the front frame 16 by the lip 56 on the plate 26. The lip 56 extends up from the plate 26 so as to impede the rotation of the side frame 8 away from the front frame 16 by blocking the upper cross brace 14.

Our invention is defined by the following claims.

We claim:

1. A walker for use by the aged or infirmed comprising:

a front frame;

a first side frame that defines a first quadrilateral;

a second side frame;

means for mounting the first side frame to the front frame such that the first side frame can rotate relative to the first frame;

means for mounting the second side frame to the front frame; and means for securing the first side frame in an open position relative to the front frame, the securing means comprising:

a member fixed to the front frame;

engagement means for rigidly engaging the first side frame to the member when the first side frame is an open position relative to the front frame; and means for releasing the rigid engagement between the first side frame and the member whereby the first side frame can be folded to a closed position relative to the front frame, wherein the releasing means is mounted within the first quadrilateral defined by the first side frame, and wherein the member is substantially contained within a space defined by the side frames and the front frame of the walker in the open position.

2. The walker of claim 1 also comprising means for securing the second side frame in an open position relative to the front frame.

3. The walker of claim 1 wherein the first side frame is in the shape of an arch defining thereby a handle portion, a front leg and a back leg, the walker further comprising a first cross-support attached to the front leg and back leg, wherein the member comprises a flat plate having a hole distal to the area where the plate is fixed to the front frame, and wherein the engagement means comprises:

a lever;

means for pivotally mounting the lever on the first cross support; and a locking pin mounted to the cross support and the lever, whereby when the locking pin is aligned with the hole in the plate, the locking pin is engaged in the hole and the first side frame is secured in the open position.

4. The walker of claim 3 wherein the lever is a chevron-shaped beam having a first end and a second end, the beam being pivoted at its fulcrum to the first cross support wherein the locking pin is mounted at the first end of the beam such that depressing the second end of the beam causes the lever to rotate about its fulcrum, raising the first end of the beam, and disengaging the locking pin.

5. The walker of claim 1 wherein the first side frame comprises hollow tubing, and the means for mounting the first side frame to the front frame comprises:

a first hinge tube mounted over the first side frame, the first hinge tube having an inner diameter slightly larger than the outer diameter of the tubing of the first side frame;

a cylindrical sleeve positioned between the hinge tube and the tubing of the first side frame;

means for positioning the hinge tube and the sleeve over a certain portion of the tubing of the first side frame; and means for fixedly securing a first end of the front frame to the first hinge tube.

6. The walker of claim 3 wherein the first cross-support is positioned below and parallel to the handle portion of the first side frame.

7. The walker of claim 5 wherein the means for positioning the hinge tube and the sleeve over a certain portion of the tubing of the first side frame comprises a side frame pin with a flat section mounted through the tubing of the first side frame wherein the bottom surfaces of the hinge tube and the sleeve are supported by the flat section of the side frame pin such that the bottom surfaces of the hinge tube and sleeve can slide on a top edge of the flat section of the side frame pin when the side frames are rotated.

8. The walker of claim 1 also comprising means for adjusting the height of the first side frame and means for adjusting the height of the second side frame.

9. The walker of claim 1 wherein the front frame has a forward bend at its center.

10. The walker of claim 1 also comprising indicator means for indicating to the user that the first side frame has engaged the fixed member.

11. The walker of claim 3 wherein the flat plate is in the shape of a section of a disk.

12. The walker of claim 3 also comprising means for preventing the first side frame from being opened by the user more than approximately 90° relative to the front frame.

13. The walker of claim 12 where the preventing means comprises an upturned lip portion on a first edge of the plate, the lip portion extending upwardly and outwardly from the first side frame.

14. A folding walker comprising:

a front frame with a left end and right end;

a left hinge tube attached to the left end of the front frame;

a right hinge tube attached to the right end of the front frame;

a left side frame rotationally mounted within the left hinge tube;

a right side frame rotationally mounted within the right hinge tube;

a left locking plate rigidly mounted at the left end of the front frame, the left locking plate having a first hole located distil to the left hinge tube;

a right locking plate rigidly mounted at the right end of the front frame, the right locking plate having a second hole located distil to the right hinge tube;

a left detent mounted on the left side frame, the left detent protruding into interlocking engagement with the first hole in the left locking plate when the left side frame is in an open position;

a right detent mounted on the right side frame, the right detent protruding into interlocking engagement with the second hole in the right locking plate when the right side frame is in the open position;

a left lever rotationally mounted on the left side frame and wherein the left lever is operatively engaged with the left detent such that depressing a first end of the left lever removes the left detent from interlocking engagement with the first hole; and a right lever rotationally mounted on the right side frame and wherein the right lever is operatively engaged with the right detent such that depressing a first end of the right lever removes the right detent from interlocking engagement with the second hole;

wherein the plates are disposed substantially between the side frames in the open position, the left lever is contained within the left side frame, and the right lever is contained within the right side frame.

15. The walker in claim 14 wherein an audible sound is produced when the left detent or the right detent protrudes into interlocking engagement with the first hole or second hole, respectively.

16. The walker in claim 14 wherein the left lever or the right lever can be easily depressed by a hand, arm or elbow.

17. The walker of claim 14 wherein the front frame has a forward bend in its center.

18. The walker of claim 14 wherein the front frame comprises an upper support and a lower support which are attached at a point equidistant from both hinge tubes and the lower support has an upward bend in its center to meet the upper support.

19. The walker of claim 14 wherein the side frames comprise an arch with two legs wherein the legs of the arch are further apart at the bottom than at the top.

20. The walker of claim 19 wherein the legs of the arch are joined by a cross-support that is fixedly mounted on each leg and on which the lever is rotationally mounted.

21. The walker of claim 19 wherein the locking plate has an edge perpendicular to the front frame, the edge extending up such that it prevents the side frame from rotating more than 90° away from the front frame.

22. The walker of claim 14 wherein the height of the side frames is adjustable by adjusting the position of feet mounted on the bottom of the side frames.

23. A folding walker comprising:

a front frame;

a first side frame rotationally mounted on the front frame such that the first side frame can rotate from a closed position adjacent to the front frame to an open position perpendicular to the front frame;

a second side frame rotationally mounted on the front frame such that the first side frame can rotate from a closed position adjacent to the front frame to an open position perpendicular to the front frame; and means for securing the first side frame in the open position, the securing means comprising:

a plate fixed to the front frame;

engagement means for rigidly engaging the first side frame to the plate when the first side frame is in the open position; and means for releasing the first side frame from rigid engagement with the plate whereby the first side frame can be rotated to the closed position, wherein the releasing means is located entirely within the first side frame, and wherein a substantial portion of the plate is located between the first side frame and the second side frame when the side frames are in the open position.

24. The walker of claim 23 wherein the engagement means comprises a detent mounted on the first side frame.

25. A walker for use by the aged or infirm comprising:

a front frame;

a first side frame having a front leg and a rear leg;

a first cross support mounted to the front leg and the rear leg;

a second side frame;

means for mounting the first side frame to the front frame such that the first side frame can rotate relative to the front frame;

means for mounting the second side frame to the front frame; and means for securing the first side frame in an open position relative to the front frame, the securing means comprising:

a member fixed to the front frame;

engagement means mounted on the first cross support for rigidly engaging the first cross support to the member when the first side frame is in an open position; and means for releasing the rigid engagement between the first side frame and the member, the releasing means being mounted on the cross support.

26. The walker of claim 25 wherein the member comprises a plate shaped in a section of a circular disc such that when the walker is in the open position the plate is contained entirely between the first side frame and the second side frame.

27. The walker of claim 25 wherein the engagement means engages the member near an edge of the member such that when the walker is in the open position the member is contained entirely in the space between the first side frame and the second side frame.

28. The walker of claim 25 wherein the member is fixed to the front frame at a point away from where the first side frame is mounted to the front frame and the engagement means is mounted on the first cross support at a point away from where the first side frame is mounted to the front frame.

* * * * *

UNITED STATES PATENT AND TRADEMARK OFFICE

CERTIFICATE OF CORRECTION

PATENT NO. : 5,201,333

DATED : April 13, 1993

INVENTOR(S) : Shalmon, et al

It is certified that error appears in the above-indentified patent and that said Letters Patent is hereby corrected as shown below:

Col. 5, line 2, "enlarge" should read "enlarged"; line 46, "3" should read "36".

Col. 6, line 26,
Claim 1, line 8, "first" should read "front".

Signed and Sealed this

Twelfth Day of April, 1994

Bruce Lehman

BRUCE LEHMAN

*Commissioner of Patents and Trademarks*

*Attest:*

*Attesting Officer*